United States Patent [19]

Duchemin

[11] 4,373,667

[45] Feb. 15, 1983

[54] DEVICES FOR ELASTICALLY FASTENING RAIL-WAY RAILS BY LOCKING

[75] Inventor: Michel Duchemin, Lambres Lez Douai, France

[73] Assignee: Ressorts Industrie, Paris, France

[21] Appl. No.: 191,765

[22] Filed: Sep. 29, 1980

[30] Foreign Application Priority Data

Oct. 2, 1979 [FR] France ..... 79 24530

[51] Int. Cl.[3] ..... E01B 9/30

[52] U.S. Cl. ..... 238/349

[58] Field of Search ..... 238/349, 287, 351, 304, 238/310, 283

[56] References Cited

U.S. PATENT DOCUMENTS

| | | | |
|---|---|---|---|
| 1,995,020 | 3/1935 | Woodings | 238/349 |
| 2,118,100 | 5/1938 | Myer | 238/349 |
| 2,254,540 | 9/1941 | Myer et al. | 238/349 |
| 2,533,055 | 12/1950 | Schulze | 238/349 |
| 3,888,414 | 6/1975 | Duchemin | 238/349 |

FOREIGN PATENT DOCUMENTS

| | | | |
|---|---|---|---|
| 1294322 | 4/1962 | France | 238/349 |
| 2148713 | 3/1973 | France | 238/349 |
| 1271186 | 4/1972 | United Kingdom | 238/349 |

*Primary Examiner*—Richard A. Bertsch

*Attorney, Agent, or Firm*—Lewis H. Eslinger

[57] ABSTRACT

The present invention relates to a new device for elastically fastening a railway rail by locking on a tie-plate, which device comprises two parts, a relatively flexible part placed above the rail flange, and a relatively rigid part situated where the device is wedged in on the tie-plate.

4 Claims, 5 Drawing Figures

DEVICES FOR ELASTICALLY FASTENING RAIL-WAY RAILS BY LOCKING

The present invention relates to new devices for elastically fastening railway rails to their sleepers by locking.

Amongst the devices used to elastically fasten a railway rail to a sleeper, some utilize an intermediate part, generally made of metal, and called tie-plate. Said tie-plate, which is secured on the sleeper by any known means, is generally provided on either side of the rail flange with at least one device permitting to grip the part which is meant to make an elastic connection between said tie-plate (and so the sleeper) and the rail. Moreover, there is generally, interposed between the metal tie-plate and the rail flange, a rubber packing-plate which is there to avoid all rigid contact between said rail and the tie-plate.

The elastic device ensuring the connection between the tie-plate and the rail is fitted in tightly against the rail either by wedging, or by screwing a bolt anchored in the tie-plate, or else by screwing a sleeper-screw anchored in the sleeper.

A good clip tightened by screwing gives the possibility of controlling the tightened state of the rail and its re-tightening in the case of wear or slackening of the rubber packing-plate; it prevents the rail from shifting due to the head of the screwing member which covers the edge of the rail flange; it is applied on the rail over a wide surface, this reducing friction wear caused by the movements of the rail.

A fastening by wedging has none of these advantages; on the other hand, the fitting in position is more rapid, and requires no special tooling and no particularly skilled labour.

The present invention relates to a device for elastically fastening a rail, which is fitted by wedging in a tie-plate, but has all the advantages of clips tightened by screwing.

This fastening device is essentially characterized in that it is made of two parts, one relatively flexible part situated above the rail flange and gripping the said flange in such a way as to follow the movements thereof, and the other, relatively rigid, which is used for wedging the device on the tie-plate and which opposes any stresses tending to shift the rail.

The most common embodiments of the invention are those which can be used with tie-plates provided, in the vicinity of the rail, with two facing lobes forming a groove inside which the fastening device can slide and, in their part most remote from the rail, with at least a support adapted to constitute an abutment for the fastening device.

According to a preferred embodiment, the invention relates to a new device for fastening elastically a railway rail on a support, by locking a clip in a tie-plate, which clip comprises a relatively rigid part and a relatively flexible part and is placed above the rail flange, device wherein:

the said tie-plate is provided, in the vicinity of the rail, with two facing lobes forming a groove and, in its part most remote from the rail, with at least one support forming abutment, the relatively rigid part of the clip is composed of two side parts forming slides and engaging under the said lobes of the tie-plate, said side parts surrounding a rigidifying middle boss, and of an end provided with means permitting to cooperate with the said tie-plate abutment.

The device according to the invention is advantageously completed by adjoining, for example to the tie-plate and if necessary to the rigid end of the clip, means permitting to control the depth of advance of the clip above the rail. One simple way of doing this is to provide a rack at the end of the tie-plate where the abutment is. This rack device is known per se and its use has already been recommended with such rail clips; but within the scope of the invention it has one particular advantage which is that it gives the possibility of controlling the length of engagement above the rail flange of the rigid part of the clip and as a result of controlling the rigidity of the said clip with respect to the rail; in addition, the rack device permits, as is well known, to take up the normal "wear" of the clip.

The invention will be better understood on reading the following description with reference to the accompanying drawings, in which.

The said figures illustrate.

Figure 2:
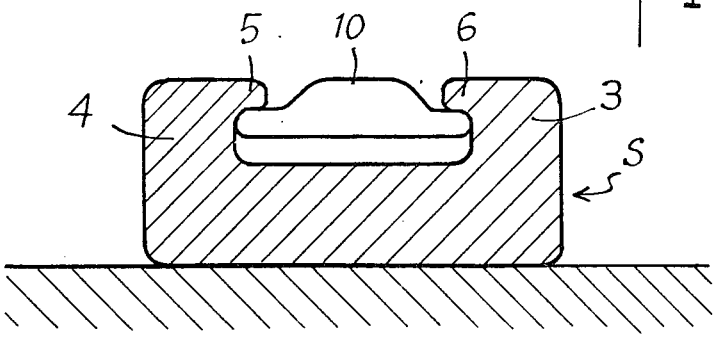
FIG. 2 is a cross-section along II—II of the device shown in FIG. 1.
Figure 5:
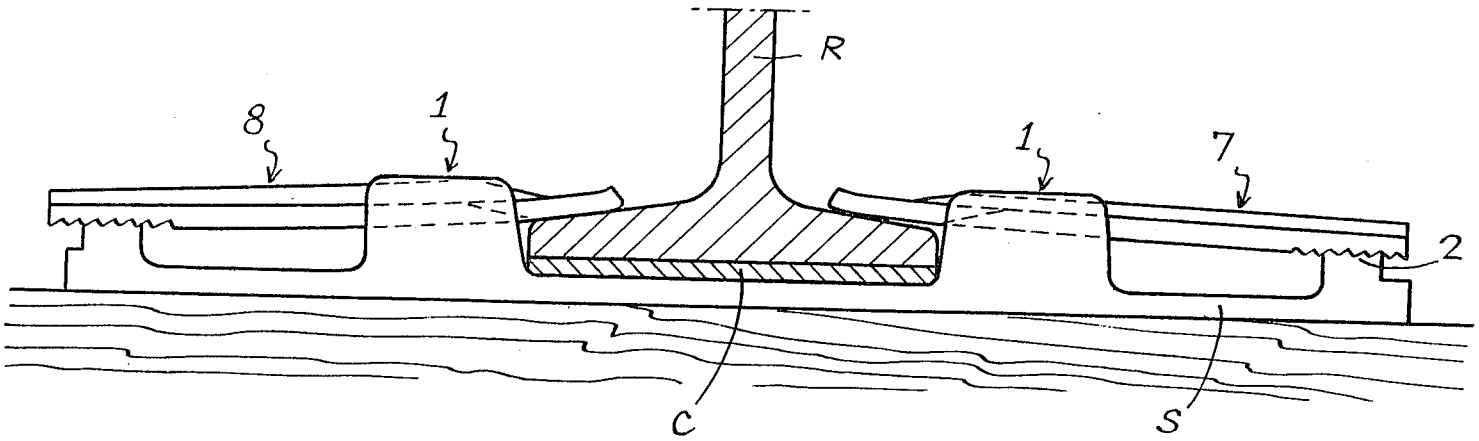
FIG. 5 shows a cross-section of a rail fixed by a device according to the invention which comprises, in its part cooperating with the tie-plate supporting device, teeth permitting to adjust the device according to the invention.

in B a sleeper, generally made of wood but which can also be made of some other material such as concrete for example;

in R the rail;

in S the tie-plate, which is made of metal and solidly secured to the sleeper by any known means; said tie-plate extends generally symmetrically on either side of the rail and comprises on each side, first in the immediate vicinity of the rail, two devices 1 with lobes and beyond a support 2, the devices with lobes permitting, due to the distance separating them, to fit the rail accurately; said rail rests on the tie-plate via a rubber packing-plate C;

the device with lobes is generally similar in structure to that shown in FIG. 2, that is to say that it comprises two columns 3 and 4 whose top part is bent inwardly so as to form, between the parts 5 and 6, a groove inside which can slide the securing device according to the invention; said device being required to rest on the lower faces of the two parts 5 and 6 of the lobes, it is obvious that said parts will need to have an adequate mechanical strength;

the supporting device 2 may be any type, it only needs to have at least a surface on which the device according to the invention can rest when it is locked in position; it will be noted, in FIG. 5, that the said supporting device takes the form of a rack permitting either to use a device according to the invention not provided at its end with a rack, but capable of being locked on one of the teeth of the rack of the supporting device, or the use of a device according to the invention whose end is also shaped as a rack.

Figure 1:
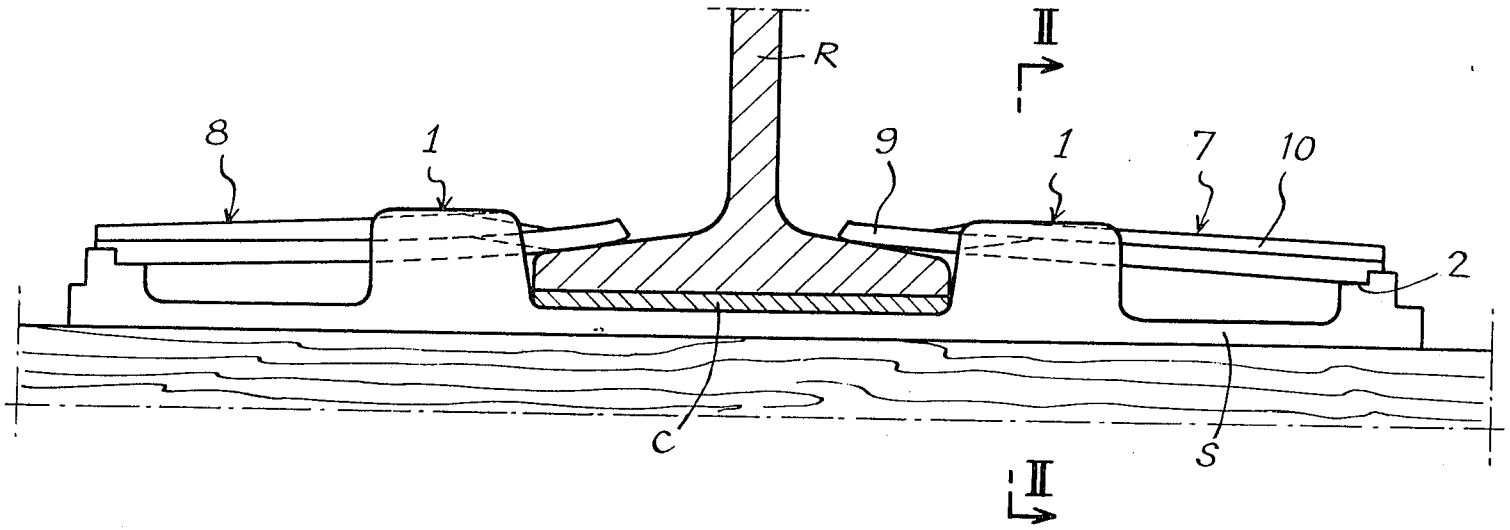
FIG. 1 shows a cross-section of a rail secured by a device according to the invention.
Figure 3:
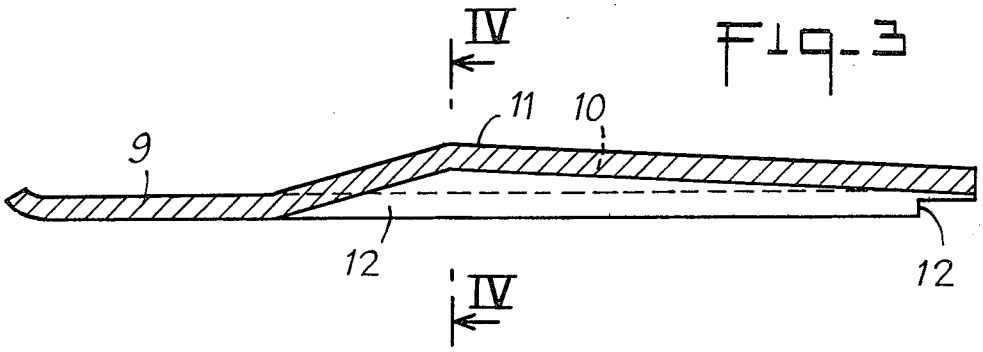
FIG. 3 is a longitudinal cross-section of a variant embodiment of the clip used to secure the rail in the device of FIG. 1.
Figure 4:
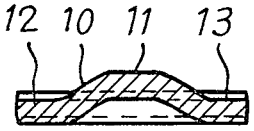
FIG. 4 is a cross-section along IV—IV of the clip shown in FIG. 3.

The device according to the invention proper comprises:

on the one hand, a relatively flexible part 9 which, when the device is fitted in, comes to rest with pressure against the rail flange; the elasticity of this part 7 should be selected so that the totality of that part which is situated above the flange comes into contact with the said flange when the rail is not under stress because of a train passing, but that the device, on the one hand, opposes a non-negligible resistance to the vertical displacements of the rail and, on the other hand, opposes the shifting of the rail by transmitting the forces to the rigid part of the device;

on the other hand, a relatively rigid part 10 extending beyond the rail, on the tie-plate, and which is used in particular for locking in the device according to the invention; said relatively rigid part 10 is advantageously made as shown in FIGS. 3 and 4, with a middle boss 11 surrounded by two side parts 12 and 13 forming slides, which will come to rest against the lower faces of the parts 5 and 6 of the lobes;

finally, an end 12 whose shape should be adapted to that of the supporting surface of the tie-plate; for the part shown in FIGS. 1, 3 and 4, said end 12 is simply constituted by a safety catch; for the part illustrated in FIG. 5, said end is constituted by a rack.

As shown in FIG. 1, the rail is held in position on the tie-plate, by placing on either side of said rail, two devices 7 and 8 according to the invention.

The fitting in of the device according to the invention is obvious to anyone skilled in the art when considering the explanations contained in the foregoing; the part is slid in under the lobes of the tie-plate, then it is pushed strongly so that its relatively flexible end comes to rest against the rail flange, and finally, at end of stroke, the end of the part is locked on the supporting face of the tie-plate.

The device according to the invention is made in spring-steel; it is possible for the relatively flexible part of the device to have the shape of a blade of thickness varying between 3 and 6 mm, whereas the relatively rigid part can be constituted by a ring of between 12 and 15 mm diameter.

What is claimed is:

1. A device for elastically fastening a rail having a flange portion to a support, comprising:

tie plate means secured to said support and including two lobe means defining a support area on which said flange portion is adapted to be supported, each lobe means including a groove, and at least one end support positioned remotely with respect to said rail; and two clip means, each engageable between said flange portion and said at least one end support, each including a resilient portion engageable with said flange portion and a rigid portion, the latter rigid portion including two side portions slidably receivable within a respective one of said grooves, a rigidifying middle portion, a first end engageable with said at least one end support and a second opposite end positioned at least immediately adjacent said flange portion.

2. A device according to claim 1; in which said second opposite end of each rigid portion is positioned in an at least partially overlapping relation with respect to said flange portion.

3. A device according to claim 1; in which at least one of said first ends includes a rack for cooperating with said at least one end support.

4. A device according to claim 1; in which an elastic plate is positioned between said support area of said tie plate means and said flange portion of said rail.

* * * * *